US006655159B1

(12) United States Patent
Boyer et al.

(10) Patent No.: US 6,655,159 B1
(45) Date of Patent: Dec. 2, 2003

(54) ACCUMULATOR DEHYDRATOR ASSEMBLY

(75) Inventors: Eugene C. Boyer, El Paso, TX (US); Mohinder Singh Bhatti, Amherst, NY (US); John Paul Telesz, East Amherst, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/222,087

(22) Filed: Aug. 16, 2002

(51) Int. Cl.[7] ..... F25B 43/00
(52) U.S. Cl. ..... 62/83; 62/503
(58) Field of Search ..... 62/474, 503, 83; 220/918, 919, 921

(56) References Cited

U.S. PATENT DOCUMENTS

| | | | | |
|---|---|---|---|---|
| 2,836,965 A | | 6/1958 | Kleist | 62/3 |
| 3,212,289 A | | 10/1965 | Bottum | 62/468 |
| 3,295,709 A | | 1/1967 | Herrick et al. | 220/9 |
| 3,847,208 A | | 11/1974 | Ollendorf | 165/1 |
| 3,999,661 A | * | 12/1976 | Jones | 206/591 |
| 4,261,501 A | * | 4/1981 | Watkins et al. | 229/404 |
| 5,377,495 A | | 1/1995 | Daigle | 62/125 |
| 5,443,177 A | * | 8/1995 | Crayne et al. | 220/62.15 |
| 5,449,035 A | | 9/1995 | Strahle et al. | 165/10 |
| 5,479,790 A | | 1/1996 | Bottum, Jr. et al. | 62/503 |
| 5,722,146 A | | 3/1998 | Seigle et al. | 29/446 |
| 5,729,998 A | | 3/1998 | Grohs et al. | 62/474 |
| 5,829,625 A | * | 11/1998 | Imagawa | 220/567.1 |
| 6,041,618 A | | 3/2000 | Patel et al. | 62/503 |
| 6,253,572 B1 | | 7/2001 | Bottum, Sr. et al. | 62/509 |
| 6,378,327 B1 | | 4/2002 | Corrigan et al. | 62/503 |

* cited by examiner

*Primary Examiner*—William E. Tapolcai
(74) *Attorney, Agent, or Firm*—Patrick M. Griffin

(57) ABSTRACT

An accumulator dehydrator assembly for use in a refrigeration cycle of an air conditioning system having an inner housing for separating the liquid component from the vapor component of the refrigerant and an integral outer shell being cup shaped and having a bottom and side walls extending upwardly from the bottom to an upper edge defining an opening is disclosed. The inner housing is disposed within and spaced from the outer shell and defines a chamber therebetween. At least one spacer is positioned between the inner housing and the outer shell and positioned annularly around the side walls and is compressed for holding the outer shell onto the inner housing. The spacers define a predetermined distance between the inner housing and the outer shell to establish the chamber while securing the outer shell onto the inner housing.

33 Claims, 6 Drawing Sheets

FIG - 10
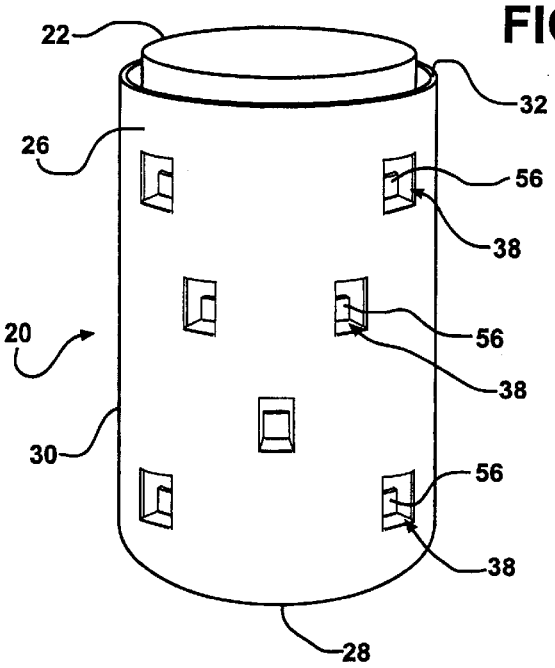
FIG - 11
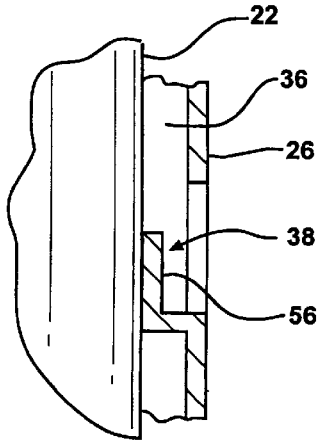
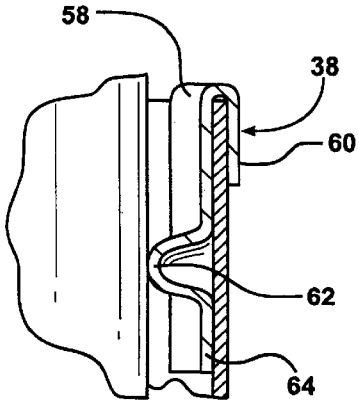
FIG - 12
FIG - 13
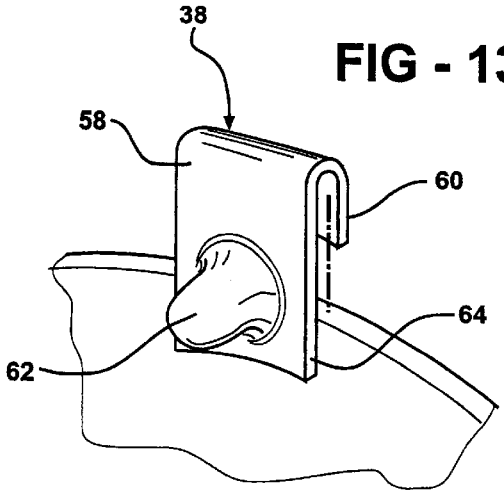

ACCUMULATOR DEHYDRATOR ASSEMBLY

BACKGROUND OF THE INVENTION

1. Field of the Invention

The subject invention relates to an accumulator dehydrator assembly for use in a refrigeration cycle of an air conditioning system of a vehicle.

2. Description of the Related Art

Various accumulator dehydrator assemblies for use in air conditioning systems of vehicles are known in the art. These assemblies have an inner housing for separating a liquid component from a vapor component of a refrigerant and an outer shell surrounding the inner housing. The outer shell is disposed around and spaced from the outer shell to define a chamber therebetween. The chamber provides an insulating layer to insulate the inner housing.

One such assembly, shown in U.S. Pat. No. 5,479,790, discloses an accumulator dehydrator assembly having an inner housing and an outer shell. The inner housing and the outer shell define a chamber therebetween. The outer shell is secured in place by a cap that engages inlets extending into the inner housing. However, the '790 patent does not disclose spacers between the inner housing and the outer shell to secure the outer shell onto the inner housing and to establish the chamber defining a predetermined distance between the inner housing and the outer shell.

Another such assembly, shown in U.S. Pat. No. 6,041,618, discloses a cylindrical sleeve mounted around an inner housing. The cylindrical sleeve has a corrugated surface for contacting the inner housing to define air pockets between the corrugations. The cylindrical sleeve is open at both ends and has a mounting bracket for engaging an engine compartment of the vehicle to secure the outer shell about the inner housing. Yet another assembly, shown in U.S. Pat. No. 6,378,327, discloses an accumulator insulator bracket having an inner housing and an outer shell. The outer shell is formed from two halves that are connected together to secure the inner housing within the outer shell. The outer shell has air flow directing ribs for directing the flow of air along the length of the inner housing. However, neither the '618 nor the '327 patent disclose spacers positioned between the inner housing and the outer shell being compressible for securing the outer shell onto the inner housing and establishing the chamber having a predetermined distance.

Accordingly, it would be advantageous to provide an outer shell that mounts to the accumulator dehydrator inner housing without connecting to the vehicle and that improves the efficiency of the air conditioning system. It would also be advantageous to provide the spacer to establish a predetermined distance between the inner housing and the outer shell to insulate the inner housing.

BRIEF SUMMARY OF THE INVENTION AND ADVANTAGES

The subject invention provides an accumulator dehydrator assembly for use in a refrigeration cycle of an air conditioning system of a vehicle. The assembly includes an inner housing for separating a liquid component from a vapor component of a refrigerant and an integral outer shell being cup shaped and having a bottom and side walls extending upwardly from the bottom to an upper edge defining an opening. The inner housing is disposed within and spaced from the outer shell to define a chamber therebetween. The assembly includes at least one spacer positioned between the inner housing and the outer shell and positioned annularly around the side walls and being compressed for holding the outer shell onto the inner housing.

The subject invention further provides a method of improving an efficiency of the air conditioning system of the vehicle. The system includes the accumulator dehydrator assembly having the inner housing for separating the liquid component from the vapor component of the refrigerant and the outer shell spaced from one another by the spacer and defining the chamber having the predetermined distance therebetween. The method includes the steps of disposing the inner housing within the outer shell, positioning the spacer between the inner housing and the outer shell, and establishing the chamber between the inner housing and the outer shell. The method includes compressing the spacers between the inner housing and the outer shell to hold the outer shell onto the inner housing.

The subject invention provides an accumulator dehydrator assembly having the outer shell that mounts to the inner housing without connecting to the vehicle and improves the efficiency of the air conditioning system. The subject invention also provides the spacer being compressible and positioned between the inner housing and the outer shell for holding the outer shell onto the inner housing and establishing the chamber having the predetermined distance between the inner housing and the outer shell to improve the efficiency of the air conditioning system.

BRIEF DESCRIPTION OF THE SEVERAL VIEW OF THE DRAWINGS

Other advantages of the present invention will be readily appreciated as the same becomes better understood by reference to the following detailed description when considered in connection with the accompanying drawings wherein:

FIG. 10 is a perspective view of the tabs of FIG. 11;

FIG. 11 is a side view of the spacer being formed as a tab within the outer shell;

FIG. 12 is a side view of the spacer being formed as a spacer clip engaging the outer shell;

FIG. 13 is a perspective view of the spacer clip of FIG. 12;

DETAILED DESCRIPTION OF THE INVENTION

Figure 1:
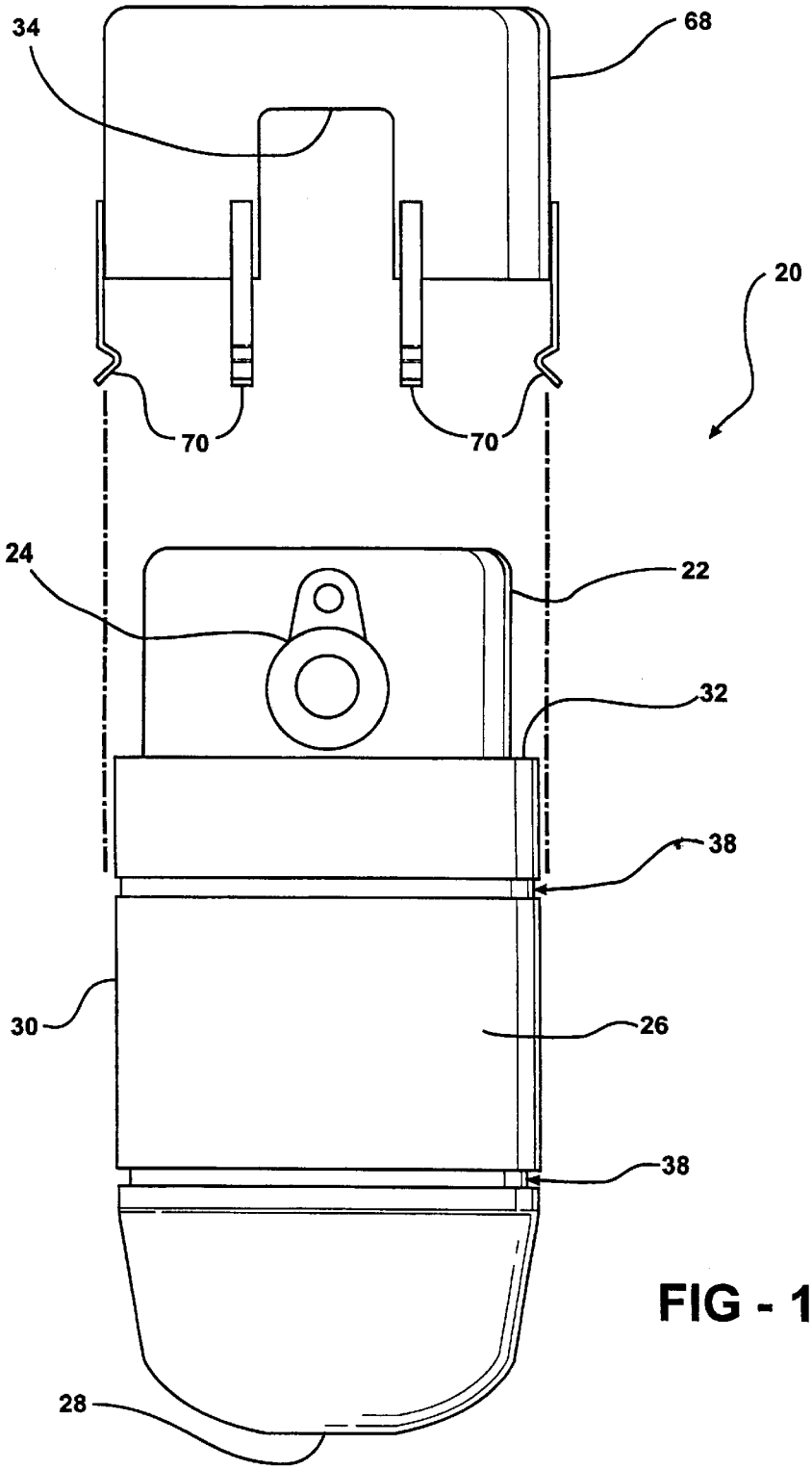
FIG. 1 is a side view of accumulator dehydrator assembly according to the subject invention having spacers integrally formed.

Referring to the Figures, wherein like numerals indicate like or corresponding parts throughout the several views, an accumulator dehydrator assembly for use in a refrigeration cycle of an air conditioning system (not shown) of a vehicle (not shown) is illustrated generally at 20 in FIG. 1. The air conditioning system typically cycles a refrigerant from a compressor (not shown) to a heat exchanger (not shown) to a pressure relief valve (not shown) to an evaporator (not shown) and back to the compressor.

The refrigerant is compressed by the compressor and leaves as a superheated vapor. The superheated vapor enters the heat exchanger and heat is transferred from the refrigerant inside the heat exchanger to air outside the heat exchanger. This causes the refrigerant to condense to a liquid form. The liquid refrigerant next goes through an expansion device and experiences a significant drop in pressure and temperature. The liquid refrigerant then goes through the evaporator and the air outside the evaporator loses energy to the refrigerant inside the evaporator. The refrigerant gains enough energy to be vaporized and then enters the accumulator dehydrator assembly 20 of the subject invention. The accumulator dehydrator assembly 20 separates any remaining liquid refrigerant from the vapor refrigerant. The vapor refrigerant is then supplied to the compressor.

Figure 2:
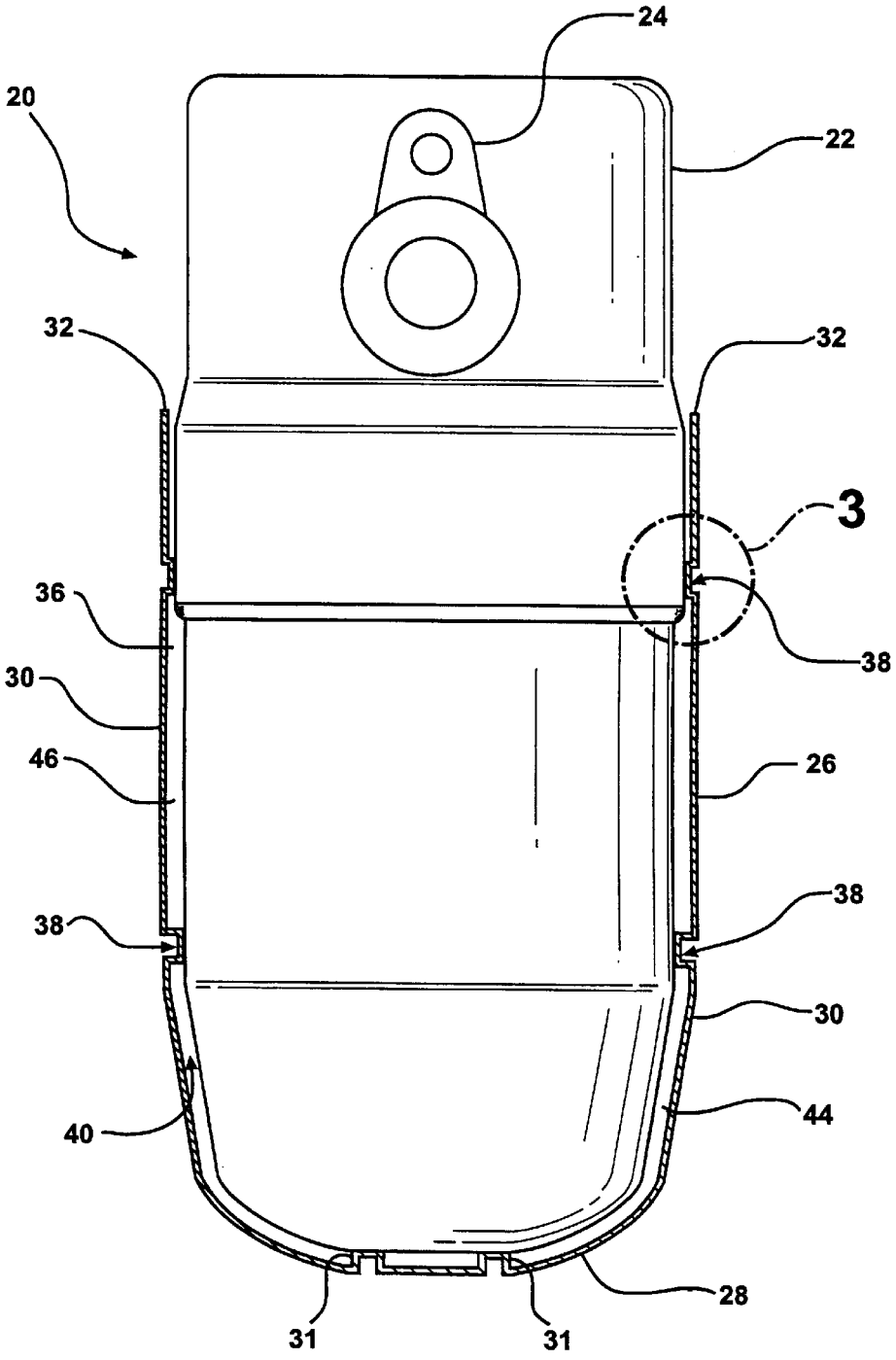
FIG. 2 is a cross-sectional view of FIG. 1.

Referring to FIGS. 1 and 2, the accumulator dehydrator assembly 20 includes an inner housing 22 for separating the liquid component from the vapor component of the refrigerant. The inner housing 22 is known to those skilled in the art as an accumulator dehydrator (A/D). The A/D is positioned downstream from the evaporator and upstream from the compressor. The refrigerant that is discharged from the evaporator may have the liquid component that should be removed from the vapor component. The refrigerant enters the A/D and the liquid component is separated from the vapor component as is known in the art. The vapor discharge from the A/D is then supplied to the compressor. The inner housing 22 has connectors 24 as is known in the art for receiving and discharging the refrigerant from the inner housing 22.

The assembly 20 further includes an integral outer shell 26 being cup shaped and having a bottom 28 and side walls 30 extending upwardly from the bottom 28 to an upper edge 32 defining an opening. The opening is large enough to receive the inner housing 22 within the outer shell 26. It is preferable that the outer shell 26 is formed in a single, continuous piece of material such that the side walls 30 and bottom 28 are continuous. The outer shell 26 may be shaped to fit various inner housings 22. For example, the side walls 30 may be tapered or straight depending upon the shape of the inner housing 22. The outer shell 26 may be formed of any type of metal or plastic, but is preferably aluminum. The outer shell 26 defines an aperture 34 for allowing the connectors 24 to pass therethrough to engage the inner housing 22.

The inner housing 22 is disposed within and spaced from the outer shell 26 and defines a chamber 36, or annulus, therebetween as shown in FIG. 2. The chamber 36, or annulus, is bounded by the inner housing 22 and the outer shell 26. Within the chamber 36, a fluid is housed between the inner housing 22 and the outer shell 26 such that convection of the fluid is limited. Preferably, the fluid is air, however, it is to be appreciated that other fluids would provide advantageous results when incorporated into the subject invention.

Figure 3:
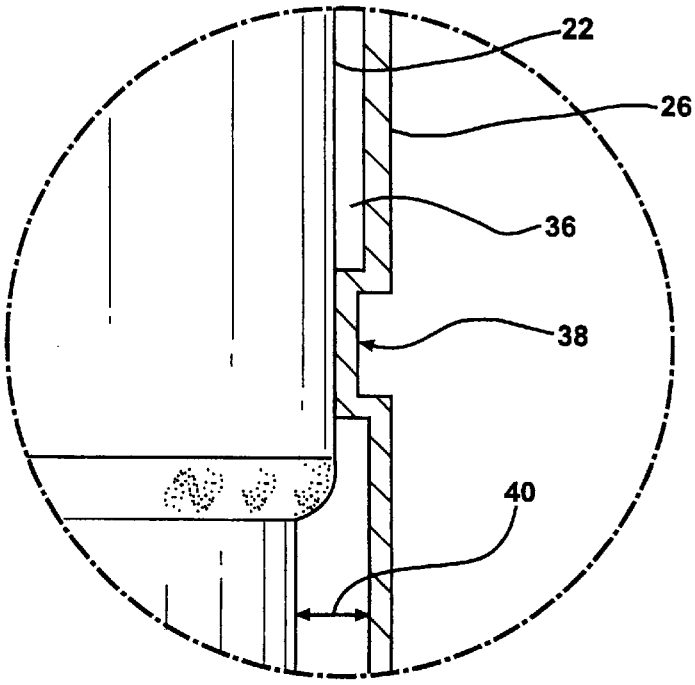
FIG. 3 is an exploded view of Line 3 in FIG. 2 showing the spacer integrally formed.

The assembly 20 includes at least one spacer 38 positioned between the inner housing 22 and the outer shell 26 and positioned annularly around the side walls 30 and being compressed for holding the outer shell 26 onto the inner housing 22. The spacers 38 define a predetermined distance 40 between the inner housing 22 and the outer shell 26 to establish the chamber 36, as shown in FIG. 3. The predetermined distance 40 is selected from a range of about 0.05 inches to about 0.50 inches, preferably from about 0.10 inches to about 0.35 inches, and most preferably from about 0.15 inches to about 0.30 inches. Additionally, a positioning spacer 31 engages the bottom 28 to ensure that the outer shell 26 has been positioned about the inner housing 22 an appropriate amount, as will be described in more detail below. The positioning spacer 31 may be the same material as the spacer 38.

In one embodiment, the predetermined distance 40 is further defined as a function of a mean hot temperature of the fluid outside the outer shell 26 and a mean cold temperature of the fluid inside the inner housing 22. The predetermined distance 40 is then calculated according to the following equation:

$$b \leq 18.2\left[\frac{T_r\mu^2}{\rho^2 g(T_a - T_r)}\right]^{1/3}$$

where, b is the predetermined distance 40 in ft, $\rho$ is a density of the fluid in the chamber 36 in $lb_m/ft^3$, g is acceleration due to gravity, which is 32.174 $ft/s^2$, $\mu$ is a dynamic viscosity of the fluid in $lb_m/fts$, $T_a$ is the mean temperature of the fluid on the hot side in ° F., and $T_r$ is the mean temperature of the fluid on the cold side in ° F.

Figure 4:
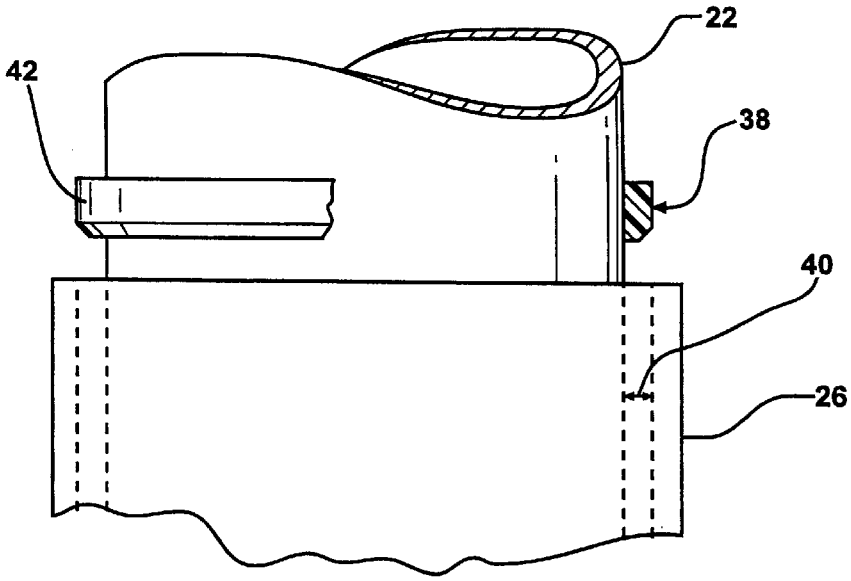
FIG. 4 is a perspective view of another embodiment of a spacer being positioned on an inner housing with an outer shell being compressibly engaging the spacer to connect to the inner housing.

In one embodiment, the spacer 38 is further defined as a belt 42, as shown in FIGS. 3 and 4. Preferably, the belt 42 is formed of a compressible material that includes, but is not limited to, rubbers, plastics, metals, and mixtures thereof. The belt 42 extends continuously around the inner housing 22. Referring to FIG. 4, the belt 42 may be a separate ring being elastic such that the belt 42 is stretched and positioned around the inner housing 22. Then, the outer shell 26 is forced onto the inner housing 22 thereby compressing the belt 42 between the inner housing 22 and the outer shell 26.

Referring back to FIG. 3, the belt 42 may be integrally formed with the outer housing and formed of the same material as the outer shell 26. Accordingly, when the outer shell 26 is forced onto the inner housing 22, the integral belt 42 compresses and mechanically connects the outer shell 26 to the inner housing 22. The belt 42 seals the chamber 36 and divides the chamber 36 into at least a first section 44 and a second section 46. The belt 42 limits the flow of the fluid between the first section 44 and the second section 46 to limit the convection properties of the fluid, as will be described more below.

Figure 5:
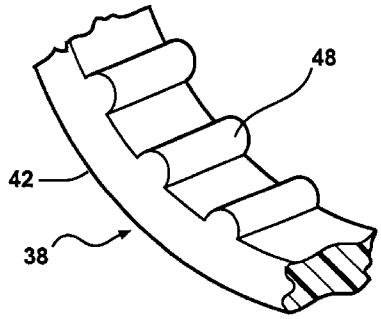
FIG. 5 is a perspective view of yet another embodiment of the spacer of FIG. 4 having a first plurality of raised portions.
Figure 6:
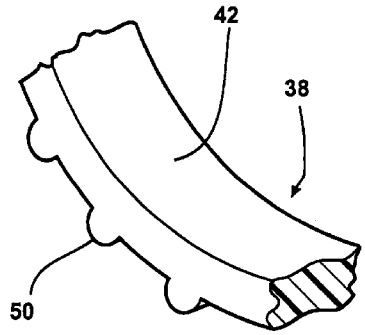
FIG. 6 is a perspective view of still another embodiment of the spacer of FIG. 4 having a second plurality of raised portions.
Figure 7:
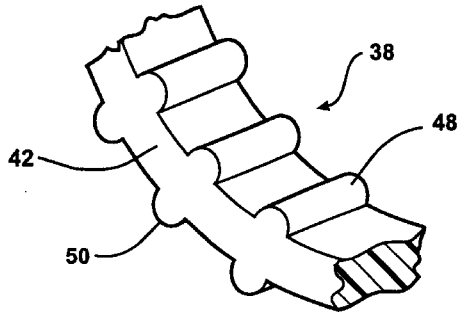
FIG. 7 is a perspective view of the spacer having both the first and second plurality of raised portions aligned with one another.
Figure 8:
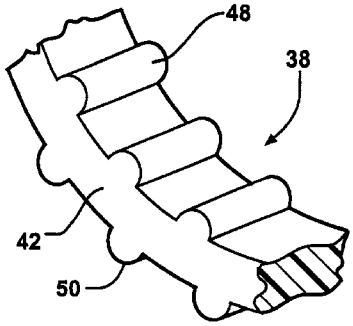
FIG. 8 is a perspective view of the spacer having both the first and second plurality of raised portions offset from one another.

Referring to FIG. 5, the belt 42 may also include a first plurality of raised portions 48 disposed in spaced and parallel relationship around the belt 42 for engaging one of the inner housing 22 and the outer shell 26. As shown in FIG. 6, the belt 42 may also include a second plurality of raised portions 50 disposed in spaced and parallel relationship around the belt 42 for engaging the other of the inner housing 22 and the outer shell 26. The first plurality of raised portions 48 and the second plurality of raised portions 50 may be radially aligned to extend in opposite directions as shown in FIG. 7. Additionally, referring to FIG. 8, the first plurality of raised portions 48 and the second plurality of raised portions 50 may be radially offset from one another about the inner housing 22 and the outer shell 26 to form the mechanical connection. Also, the raised portions allow limited movement of the fluid between the first section 44 and the second section 46.

Figure 9:
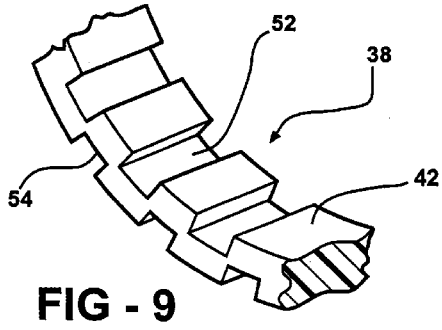
FIG. 9 is a perspective view of the spacer having a first and a second plurality of recessed portions.

Alternately, referring to FIG. 9, the belt 42 may include a first plurality recessed portions disposed in spaced and parallel relationship around the belt 42 for allowing fluid to flow therebetween. A second plurality of recessed portions 54 are disposed in spaced and parallel relationship around the belt 42 and facing in an opposite direction from the first recessed portions for allowing fluid to flow therebetween. Similar to the raised portions, the first plurality of recessed portions 52 and the second plurality of recessed portions 54 may be radially offset from one another whereby the first recessed portions and the second recessed portions alternate around the inner housing 22 and the outer shell 26. The recessed portions allow the fluid to flow between the first section 44 and the second section 46 without allowing additional fluid from outside the outer shell 26 to enter the chamber 36.

With reference to FIGS. 10 and 11, the spacer 38 may also be defined as a tab 56 integrally formed in the side walls 30 and extending therefrom for engaging the inner housing 22. The tab 56 is formed of the same material as the outer shell 26 and is preferably aluminum. The tab 56 is formed in a punch-type process whereby the side wall 30 of the outer shell 26 is bent inwardly toward the inner housing 22. The tab 56 is then bent upwardly toward the opening or downwardly toward the bottom 28 to form a generally "L" shaped tab 56. The tab 56 engages in the inner housing 22 and is compressed to mechanically connect the outer shell 26 to the inner housing 22.

The spacer 38 may further be defined as a spacer clip 58 engaging the upper edge 32 of the outer shell 26, as shown in FIGS. 12 and 13. The spacer clip 58 is compressed between the inner housing 22 and the outer shell 26. The spacer clip 58 may be formed of a metal, a plastic, or the like. The spacer clip 58 includes a U-shaped portion 60 for engaging the upper edge 32 and a raised dimple 62 being compressed between the inner housing 22 and the outer shell 26. An arm 64 extends from the U-shaped portion 60 between the inner housing 22 and the outer shell 26. The raised dimple 62 extends from the arm 64 for engaging one of the inner housing 22 and the outer shell 26. Additionally, the spacer clip 58 may be formed with a tab similar to that shown in FIG. 11 in place of the raised dimple 62. The spacer clips 58 are positioned around the edge of the outer shell 26 and then the outer shell 26 is forced onto the inner housing 22. The raised dimple 62 or tab compresses and mechanically connects the outer shell 26 to the inner housing 22.

Figure 14:
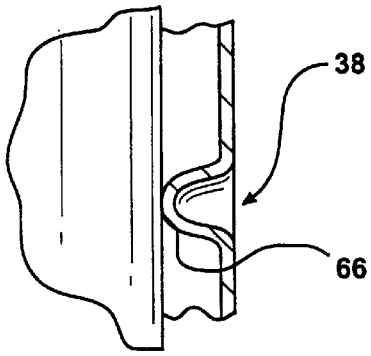
FIG. 14 is a side view of the spacer being integrally formed with the outer shell as a bump.
Figure 15:
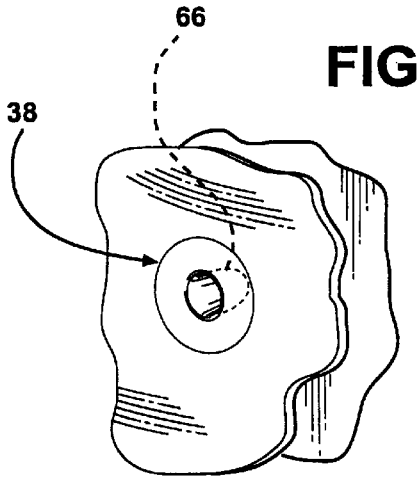
FIG. 15 is a perspective view of the bump of FIG. 14.

Referring to FIGS. 14 and 15, the spacer 38 may also be further defined as bumps 66 integrally formed in the side walls 30 and engaging the inner housing 22. The bumps 66 may be oval or circular and are compressible. The bumps 66 are preferably integrally formed within the outer shell 26, but may be formed separately and mounted to either one of the inner housing 22 and the outer shell 26. It is preferable that the bumps 66 are formed in the outer shell 26 for engaging the inner housing 22 to ease installation of the outer shell 26. When the outer shell 26 is forced onto the inner shell, the bumps 66 are compressed to mechanically connect the outer shell 26 to the inner housing 22.

The subject invention may further include a cap 68 engaging the outer shell 26 and enclosing the inner housing 22 within the outer shell 26 and the cap 68. The cap 68 has cap clips 70 extending from the cap 68 for engaging the outer shell 26 and securing the cap 68 to the outer shell 26. The cap clips 70 may be integrally formed with the cap 68 or secured to the cap 68 separately. Additionally, the cap 68 may include the spacers 38 for establishing the chamber 36 as described above to establish the predetermined distance 40 between the inner housing 22 and the cap 68. The cap 68 may have dimples in place of the cap clips 70 such that the dimples engage the outer shell 26 for securing the cap thereto.

The subject invention further provides a method of improving an efficiency of the air conditioning system of the vehicle. The method includes the steps of disposing the inner housing 22 within the outer shell 26, positioning the spacer 38 between the inner housing 22 and the outer shell 26, and establishing the chamber 36 between the inner housing 22 and the outer shell 26.

The method includes compressing the spacers 38 between the inner housing 22 and the outer shell 26 to hold the outer shell 26 onto the inner housing 22. Compressing the spacer 38 establishes and maintains the predetermined distance 40 between the inner housing 22 and the outer shell 26. The outer shell 26 is pressed over the inner housing 22 and the force compresses the spacers 38. The outer shell 26 is pressed until the positioning spacer 31 contacts the inner housing 22. Once the positioning spacer 31 contacts the inner housing 22, the outer shell 26 is properly positioned.

In order to establish the predetermined distance 40, a circumambient temperature outside of the outer shell 26, i.e., in an engine compartment of the vehicle, is measured and an accumulator, or refrigerant, temperature inside of the inner housing 22 is measured. An average temperature of the circumambient temperature and the accumulator temperature is calculated so that a dynamic viscosity for the fluid and a density of the fluid can be calculated at the average temperature. A coefficient of thermal expansion for the fluid is also calculated. These values are then used to calculate the predetermined distance 40 between the inner housing 22 and the outer shell 26 that results in a decreased amount of work being performed by the system. Next, the outer shell 26 is positioned the predetermined distance 40 from the inner housing 22 to decrease the amount of work.

Figure 16:
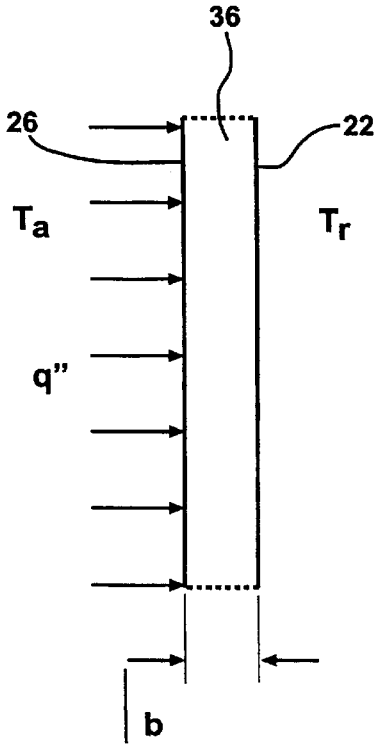
FIG. 16 is a side view of the inner housing and the outer shell representing the direction of heat flow and a predetermined distance insulated in the inner housing for calculating the predetermined distance.

The subject invention provides the predetermined distance 40 between the inner housing 22 and the outer shell 26 to serve as an insulation layer. Since the thermal conductivity of air is very low, it can serve as an excellent insulator provided that the free-convection currents are suppressed within the chamber 36. The predetermined distance 40 around the inner housing 22 is representable by a parallel plate channel enclosed around its edges to form a box, as shown in FIG. 16. On one side of the chamber 36, the temperature $T_r$ is the temperature of the refrigerant and on the other side of the chamber 36 the temperature $T_a$ is the temperature of the circumambient air in the engine compartment. It may be noted that in the engine compartment of the vehicle $T_a > T_r$ so that the heat transfer takes place from the circumambient air to the refrigerant across the predetermined distance 40 as indicated by the direction of the heat flux $q^n$ in FIG. 16.

The insulative properties of the chamber 36 around the inner housing 22 lowers the refrigerant temperature in the inner housing 22. The lower refrigerant temperature in the inner housing 22 results in a lower refrigerant temperature at the compressor suction ports. The efficiency of the air conditioning system is improved because less isentropic work of compression, W, is required. The work of compression is directly proportional to a suction temperature $T_{suc}$ of the refrigerant and is shown in equation (1) as:

$$W = \frac{RT_{suc}}{(n-1)}\left[\left(\frac{P_{dis}}{P_{suc}}\right)^{n-1/n} - 1\right] \tag{1}$$

where $P_{suc}$ is the suction pressure of the refrigerant supplied to the compressor, $P_{dis}$ is the discharge pressure of the refrigerant exiting the compressor, R is the gas constant and n is the polytropic index of the refrigerant. n is further defined in equation (2) as $$n = 1 + \frac{1}{1 + Jc_p^0(T_{suc})}\left(\frac{2}{2 - Z_c^2}\right) \tag{2}$$

where $c_p^o(T_{suc})$ is the zero-pressure isobaric specific heat of the refrigerant calculated at the suction temperature, $T_{suc}$, $Z_c$ is the critical compressibility of the refrigerant and J is the mechanical-to-thermal energy conversion factor. Thus, from equation (1), the presence of the fluid in the chamber 36 around the inner housing 22 lowers the work of compression due to the refrigerant having the lower suction temperature, $T_{suc}$. This results in higher energy efficiency of the air conditioning system and provides a relatively inexpensive way of insulating the refrigerant in the inner housing 22 from the circumambient air temperatures in the engine compartment of the vehicle. However, the predetermined distance 40 must be optimized to provide the maximum improved efficiency of the air conditioning system.

The predetermined distance 40 has a desired distance that will provide the maximum improved efficiency of the air conditioning system due to the insulative value of the chamber 36. For the illustrative system shown in FIG. 16, an overall heat transfer coefficient U in the chamber 36 is expressible as $$\frac{1}{U} = \frac{1}{h_r} + \frac{b}{k_a} + \frac{1}{h_a} \tag{3}$$

where $h_r$ is the free convection heat transfer coefficient in the chamber 36 on the refrigerant side in Btu/sft$^{2}$° F., $h_a$ is the free convection heat transfer coefficient in the chamber 36 on the circumambient air side in Btu/sft$^{2}$° F., $k_a$ is the thermal conductivity of the fluid in Btu/sft° F., and b is the predetermined distance 40 in ft.

In equation (3), $1/h_r$ represents convective resistance on the refrigerant side, $b/k_a$ represents the conductive resistance of the chamber 36 having the predetermined distance 40, and $1/h_a$ represents the convective resistance on the air side. When the free convection in the chamber 36 is suppressed due to the spacers 38 secures the outer shell 26 onto the inner housing 22, then $1/h_r=1/h_a=0$ and the heat flow is by pure conduction alone. For pure conduction, equation (3) yields $U=k_a/b$.

The process of free convection of heat transfer in the chamber 36 shows that $U=k_a/b$ for $$Gr \equiv \frac{\rho^2 g\beta(T_a - T_r)b^3}{\mu^2} \leq 6000 \tag{4}$$

where Gr is the dimensionless group called the Grashof number representing the ratio of buoyant force to viscous force, ρ is the density of the fluid in $lb_m/ft^3$, g is the acceleration due to gravity, which is 32.174 ft/s$^2$, β is the coefficient of thermal expansion for the fluid defined below in 1/° F., $\mu$ is the dynamic viscosity of the fluid in $lb_m$/fts, b is the predetermined distance 40 in ft, $T_a$ is the fluid mean temperature on the hot side in ° F., and $T_r$ is the fluid mean temperature on the cold side in ° F.

The coefficient of thermal expansion β for the fluid at any temperature T is defined as $$\beta = \frac{\rho_r - \rho}{\rho(T - T_r)} \tag{5}$$

where ρ is the fluid density at temperature T and $\rho_r$ is the fluid density at temperature $T_r$.

For an ideal gas, ρ=P/RT where P is the pressure and R is the gas constant. Introducing this into equation (5), β is expressible as $$\beta = \frac{\rho_r/\rho - 1}{T - T_r} = \frac{T_r/T - 1}{T - T_r} = \frac{1}{T_r} \tag{6}$$

Introducing equation (6) into equation (5), the suppression of the free convection is expressible as:

$$\frac{\rho^2 g(T_a - T_r)b^3}{T_r\mu^2} \leq 6000 \tag{7}$$

Solving for b, $$b \leq 18.2\left[\frac{T_r\mu^2}{\rho^2 g(T_a - T_r)}\right]^{1/3} \tag{8}$$

Equation (8) gives the desired distance for the predetermined distance 40 as a function of the properties of the fluid within the chamber 36 and the mean temperatures of the two fluids on the opposite sides of the chamber 36. Shown below in Table 1 are the results for the predetermined distance 40, under an idle condition and a traveling condition, or a down-the-road condition. The idle condition is defined as the vehicle engine is operating and the vehicle is stationary. The traveling condition is defined as the vehicle engine is operating and the vehicle is traveling at a 50 miles per hour down the road. The results are presented below in tabular form. The results show that in one embodiment under idle conditions, b≦0.161 inches and under down-the-road conditions, b≦0.150.

TABLE 1

Predetermined distance 40 around the inner housing 22 under idle and down-the-road conditions

| | Idle | Down-the-road |
|---|---|---|
| $T_a$, ° F. | 200 | 150 |
| $T_r$, ° F. | 73 | 40 |
| $\bar{T} = (T_a + T_r)/2$, ° F. | 136.5 | 120.95 |

TABLE 1-continued

| Predetermined distance 40 around the inner housing 22 under idle and down-the-road conditions | | |
|---|---|---|
| | Idle | Down-the-road |
| $\mu$ ($\overline{T}$), $lb_m$/fts | $1.3416 \times 10^{-5}$ | $1.2762 \times 10^{-5}$ |
| $\rho$ ($\overline{T}$), $lb_m/ft^3$ | 0.0670 | 0.0717 |
| b, in., Eq. (8) | ≦0.161 | ≦0.150 |

From these results, the efficiency of the air conditioning system is improved when the predetermined distance 40 is selected from a range of about 0.05 inches to about 0.50 inches, preferably from about 0.10 inches to about 0.35 inches, and most preferably from about 0.15 inches to about 0.30 inches. The spacers 38 are constructed to provide the predetermined distance 40 between the inner housing 22 and outer shell 26. As a result, the outer shell 26 is repositioned to obtain the most improved efficiency of the air conditioning system.

Obviously, many modifications and variations of the present invention are possible in light of the above teachings. The invention may be practiced otherwise than as specifically described within the scope of the appended claims.

What is claimed is:

1. An accumulator dehydrator assembly for use in a refrigeration cycle of an air conditioning system of a vehicle, said assembly comprising:

an inner housing for separating a liquid component from a vapor component of a refrigerant;

an integral outer shell being cup shaped and having a bottom and side walls extending upwardly from said bottom to an upper edge defining an opening;

said inner housing disposed within and spaced from said outer shell to define a chamber therebetween; and at least one spacer positioned between said inner housing and said outer shell and positioned annularly around said side walls and being compressed for holding said outer shell onto said inner housing.

2. An assembly as set forth in claim 1 wherein said spacer is further defined as a belt.

3. An assembly as set forth in claim 2 wherein said belt extends continuously around said inner housing.

4. An assembly as set forth in claim 3 wherein said belt is integrally formed with said outer shell.

5. An assembly as set forth in claim 3 further including a first plurality of raised portions disposed in spaced and parallel relationship around said belt for engaging one of said inner housing and said outer shell.

6. An assembly as set forth in claim 5 further including a second plurality of raised portions disposed in spaced and parallel relationship around said belt for engaging the other of said inner housing and said outer shell.

7. An assembly as set forth in claim 6 wherein said first plurality of raised portions and said second plurality of raised portions are radially aligned to extend in opposite directions.

8. An assembly as set forth in claim 6 wherein said first plurality of raised portions and said second plurality of raised portions are radially offset from one another about said inner housing and said outer shell.

9. An assembly as set forth in claim 3 further including a first plurality of recessed portions disposed in spaced and parallel relationship around said belt for allowing fluid to flow therebetween.

10. An assembly as set forth in claim 1 wherein said spacer is further defined as a tab integrally formed in said side walls and extending therefrom for engaging said inner housing.

11. An assembly as set forth in claim 10 further including a second plurality of recessed portions disposed in spaced and parallel relationship around said belt and facing in an opposite direction from said first recessed portions for allowing fluid to flow therebetween.

12. An assembly as set forth in claim 1 wherein said spacer is further defined as a spacer clip engaging said upper edge of said outer shell and compressed between said inner housing and said outer shell.

13. An assembly as set forth in claim 12 wherein said first plurality of recessed portions and said second plurality of recessed portions are radially offset from one another whereby said first plurality of recessed portions and said second plurality of recessed portions alternate around said inner housing and said outer shell.

14. An assembly as set forth in claim 12 wherein said spacer clip further includes a U-shaped portion for engaging said edge and a raised dimple being compressed between said inner housing and said outer shell.

15. An assembly as set forth in claim 12 wherein said spacer clip further includes a U-shaped portion for engaging said edge and a tab being compressed between said inner housing and said outer shell.

16. An assembly as set forth in claim 1 wherein said spacer is further defined as a bump integrally formed in said side walls and engaging said inner housing.

17. An assembly as set forth in claim 1 further including a cap engaging said outer shell and enclosing said inner housing within said outer shell and said cap.

18. An assembly as set forth in claim 17 further including cap clips extending from said cap for engaging said outer shell and securing said cap to said outer shell.

19. An assembly as set forth in claim 1 wherein said spacers define a predetermined distance between said inner housing and said outer shell to establish said chamber.

20. An assembly as set forth in claim 19 wherein said predetermined distance is selected from a range of about 0.05 inches to about 0.50 inches.

21. An assembly as set forth in claim 19 wherein said predetermined distance is selected from a range of about 0.10 inches to about 0.35 inches.

22. An assembly as set forth in claim 19 wherein said predetermined distance is selected from a range of about 0.15 inches to about 0.30 inches.

23. An assembly as set forth in claim 19 wherein said predetermined distance is further defined as a function of a mean hot temperature and of a mean cold temperature of said fluid, wherein said hot temperature is defined as said fluid outside of said outer housing and said cold temperature is defined as said fluid inside of said inner housing.

24. An assembly as set forth in claim 23 wherein said predetermined distance is further defined as:

$$b \leq 18.2\left[\frac{T_r\mu^2}{\rho^2 g(T_a - T_r)}\right]^{1/3}$$

where, b is said predetermined distance in ft, p1 ρ is a density of a fluid in said chamber represented in $lb_m/ft^3$, g is acceleration due to gravity, which is 32.174 $ft/s^2$, $\mu$ is a dynamic viscosity of said fluid in $lb_m$/fts, $T_a$ is said mean temperature of said fluid on the hot side in ° F., and $T_r$ is said mean temperature of said fluid on the cold side in ° F.

25. An assembly as set forth in claim 24 wherein said fluid is further defined as air.

26. A method of improving an efficiency of an air conditioning system of a vehicle, the system including an accumulator dehydrator assembly for use in a refrigeration cycle having an inner housing for separating a liquid component from a vapor component of a refrigerant and an outer shell spaced from one another by a spacer and defining an chamber having a predetermined distance, said method comprising the steps of:

disposing the inner housing within the outer shell;

positioning the spacer between the inner housing and the outer shell;

establishing the chamber between the inner housing and the outer shell; and compressing the spacers between the inner housing and the outer shell to hold the outer shell onto the inner housing.

27. A method as set forth in claim 26 wherein the step of compressing the spacer further includes the step of establishing and maintaining the predetermined distance between the inner housing and the outer shell.

28. A method as set forth in claim 27 wherein the step of establishing and maintaining the predetermined distance further includes the steps of:

measuring an circumambient temperature outside of the outer shell;

measuring an accumulator temperature inside of the inner housing;

calculating an average temperature of the circumambient temperature and the refrigerant temperature;

calculating a dynamic viscosity for the fluid at the average temperature;

calculating a density of the fluid at the average temperature; and calculating a coefficient of thermal expansion for the fluid; and calculating the predetermined distance between the inner housing and the outer shell that results in a decreased amount of work being performed by the system and positioning the outer shell the predetermined distance from the inner housing.

29. A method as set forth in claim 28 wherein calculating the predetermnined distance is further defined as:

$$b \leq 18.2\left[\frac{T_r\mu^2}{\rho^2 g(T_a - T_r)}\right]^{1/3}$$

where, b is the predetermined distance represented in ft,

ρ is the density of a fluid in the chamber at the average temperature represented in $lb_m/ft^3$, g is acceleration due to gravity having a value of 32.174 $ft/s^2$, $\mu$ is the dynamic viscosity of the fluid at the average temperature represented in $lb_m/fts$, $T_a$ is the mean temperature of the fluid on the hot side represented in ° F., and $T_r$ is the mean temperature of the fluid on the cold side represented in ° F.

30. A method as set forth in claim 29 further including the step of calculating the work performed by the system in response to the outer shell being spaced the predetermined distance from the inner housing.

31. A method as set forth in claim 30 wherein the work is calculated as:

$$W = \frac{RT_{suc}}{(n-1)}\left[\left(\frac{P_{dis}}{P_{suc}}\right)^{n-1/n} - 1\right]$$

where the work, W, is directly proportional to a suction temperature, $T_{suc}$, of the refrigerant supplied to a compressor, a suction pressure, $P_{suc}$, of the refrigerant supplied to the compressor, a discharge pressure, $P_{dis}$, of the refrigerant being discharged from the compressor, a gas constant, R, and a polytropic index of the refrigerant, n.

32. A method as set forth in claim 31 further including calculating the polytropic index of the refrigerant is further defined as:

$$n = 1 + \frac{1}{1 + Jc_p^0(T_{suc})}\left(\frac{2}{2 - Z_c^2}\right)$$

where $c_p^0$ $(T_{suc})$ is a zero-pressure isobaric specific heat of the refrigerant calculated at the suction temperature $T_{suc}$, $Z_c$ is a critical compressibility of the refrigerant and J is a mechanical-to-thermal energy conversion factor.

33. A method as set forth in claim 32 further including the step of repositioning the outer shell the predetermined distance from the inner housing to obtain a minimum amount of work performed by the system.

* * * * *